US006869374B1

(12) United States Patent
Lane

(10) Patent No.: US 6,869,374 B1
(45) Date of Patent: Mar. 22, 2005

(54) OUTDOOR DART GAME

(76) Inventor: Keith E. Lane, 52 Sheep Street, Townsend Hall Flat, Shipston-On-Stour, Warwickshire (GB), CV36 4AE ( * ) Notice: Subject to any disclaimer, the term of this patent is extended or adjusted under 35 U.S.C. 154(b) by 0 days.

(21) Appl. No.: 10/783,688

(22) Filed: Feb. 23, 2004

(51) Int. Cl.[7] ..... A63B 65/02
(52) U.S. Cl. ..... 473/578; 273/317
(58) Field of Search ..... 473/518–586; 273/317, 348

(56) References Cited

U.S. PATENT DOCUMENTS

| | | | | | |
|---|---|---|---|---|---|
| 1,737,871 | A | | 12/1929 | Vaughan | |
| 2,923,548 | A | | 2/1960 | Kappel | |
| 3,021,640 | A | * | 2/1962 | Moore | 446/231 |
| 3,565,432 | A | | 2/1971 | Reiner | |
| 3,596,910 | A | | 8/1971 | Rizzo | |
| 3,672,678 | A | * | 6/1972 | Rizzo | 473/585 |
| 3,709,495 | A | | 1/1973 | Krombein | |
| 3,957,271 | A | * | 5/1976 | Kurtz et al. | 473/586 |
| 3,982,762 | A | | 9/1976 | Milicic | |
| 4,836,557 | A | * | 6/1989 | Polando | 473/578 |
| 4,887,822 | A | | 12/1989 | Tsai | |
| 5,067,728 | A | * | 11/1991 | Dadbeh | 473/585 |
| 5,118,117 | A | * | 6/1992 | Denen | 473/585 |
| 5,223,667 | A | * | 6/1993 | Anderson | 102/517 |
| 5,362,066 | A | | 11/1994 | Sassak | |
| 5,375,848 | A | | 12/1994 | Coleman | |
| 5,443,272 | A | * | 8/1995 | Vincent, Sr. | 473/578 |
| 5,465,980 | A | * | 11/1995 | Maurin | 473/578 |
| 5,836,842 | A | * | 11/1998 | McLearan | 473/581 |
| 5,895,331 | A | * | 4/1999 | Rinehart | 473/578 |
| 6,139,452 | A | | 10/2000 | McSherry et al. | |
| 6,277,041 | B1 | * | 8/2001 | Fenn | 473/578 |
| 6,520,876 | B1 | * | 2/2003 | Eastman, II | 473/578 |
| 6,758,772 | B1 | * | 7/2004 | Chambers et al. | 473/578 |
| 6,758,773 | B1 | * | 7/2004 | Liao et al. | 473/578 |

FOREIGN PATENT DOCUMENTS

| | | | | |
|---|---|---|---|---|
| GB | 2049448 | A | * 12/1980 | A63B/65/02 |

* cited by examiner

*Primary Examiner*—Mark S. Graham

(57) ABSTRACT

An outdoor dart game includes a plurality of darts having a shaft section and a tip member removably attachable to the front end portion of the shaft. A flight section is removably engageable with the shaft section and includes a plurality of flight members integral with each other and extending radially and outwardly from the longitudinal axis. Rubber covers may be connected to the shaft and flight sections respectively for providing a surface that a user may grip while handling the plurality of darts. Each dart may further include a flexible cord attachable to the shaft section and defining a loop for receiving a portion of a hand of a user so that same can throw the plurality of darts further. The game further includes a target pad, which may be selectively positioned at a remote distance from the plurality of darts.

19 Claims, 3 Drawing Sheets

OUTDOOR DART GAME

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to an outdoor dart game and, more particularly, to an outdoor dart game including a plurality of darts provided with a grip cord for assisting a player to throw the dart a greater distance.

2. Prior Art

Outdoor game darts or javelins are well known and are commonly called lawn darts. Such darts are generally similar in structure to indoor game darts but are of a relatively larger size. Lawn darts are played on an outdoor field in which a target area is established on the ground and the players throw the darts from a selected distance in order that the darts would fall and thrust in the ground within the target area. Lawn darts must necessarily be strong in structure since they are subject to a large amount of punishment even under normal use; yet they must be simple in structure such that they can be easily and economically manufactured on a commercial scale.

Conventional darts typically include an elongated shaft onto which a user maintains a firm grip when he/she throws the darts across a predetermined distance. Unfortunately, it is exceedingly difficult to maintain a secure grip of the dart shaft when a player wants to throw the dart a far distance. The ability to throw a dart a greater distance brings excitement to the game and enhances the challenge for the players.

Accordingly, a need remains for an outdoor dart game including a plurality of darts, which are provided with a cord for assisting a player to maintain a firm grip of the dart when he/she is throwing same.

BRIEF SUMMARY OF THE INVENTION

In view of the foregoing background, it is therefore an object of the present invention to provide an outdoors dart game for overcoming the above-noted shortcomings. These and other objects, features, and advantages of the invention are provided by an outdoors dart game including a plurality of darts including a shaft section, having front and rear end portions, which has a centrally disposed longitudinal axis and a substantially smooth outer surface equally spaced therefrom.

The invention further includes a tip member preferably having a substantially conical shape, which may be removably attached to the front end portion of the shaft. The front end portion of the shaft may have a threaded aperture and the tip member may have an end portion threadably engageable with the aperture. A flight section, removably engageable with the shaft section, is disposed rearward thereof. The flight section provides aerodynamic stability while the plurality of darts are transported between remote locations.

Furthermore, the flight section preferably includes a plurality of flight members integral with each other and extending radially and outwardly from the longitudinal axis. The flight section further includes a front end portion having an outer surface converging distally from a center thereof and the rear end portion of the shaft section has a tongue formed thereat for receiving the converging front end portion of the flight section.

A plurality of rubber covers may be connected to the shaft and flight sections respectively for providing a surface, which a user may grip while handling the plurality of darts. The game further includes at least one target pad including indicia thereon for identifying various point values. Such target pads may be selectively positioned at a remote distance from the plurality of darts, as desired by a player. Advantageously, each dart preferably includes a flexible cord attachable to the shaft section and defining a loop for receiving a portion of a hand of a user so that same can throw the dart a further distance.

In an alternate embodiment, the shaft section may include a plurality of elongated shaft portions removably attachable to each other so that a length of the shaft section can be selectively adjusted as desired by a user. Such a plurality of shaft portions include a plurality of flange portions and have a plurality of notches for receiving same so that the shaft section can be maintained at a substantially stable position during operating conditions.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
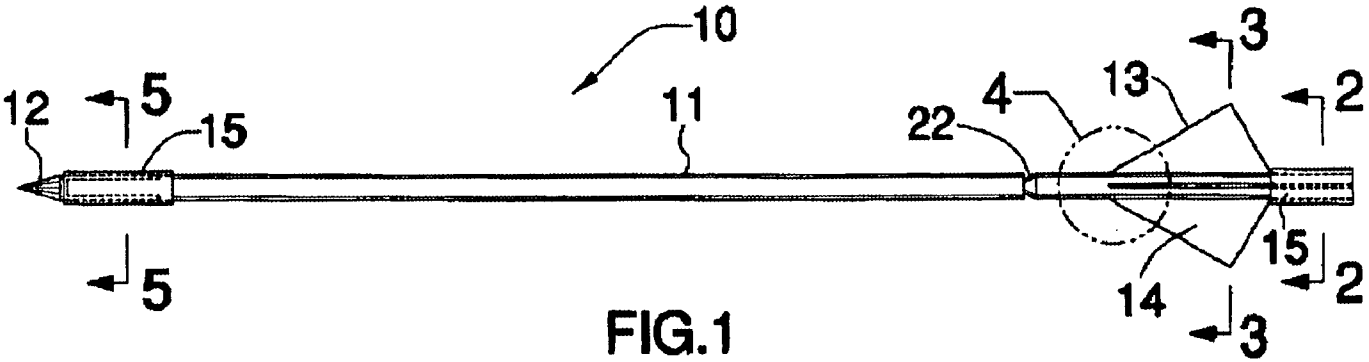
FIG. 1 is a perspective view showing a dart of an outdoor dart game, in accordance with the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements and prime notations refer to alternate elements throughout the figures.

The invention is referred to generally in FIGS. 1–7 by the reference numeral 10 and is intended to provide an outdoor dart. It should be understood that the present invention may be used indoors as well as outdoors by taking the proper precautions and adhering to obvious safety standards.

Referring initially to FIG. 1, an outdoors dart game includes a plurality of darts 10 including a shaft section 11, having front and rear end portions, which has a centrally disposed longitudinal axis (not shown) and a substantially smooth outer surface equally spaced therefrom.

The invention further includes a tip member 12 preferably having a substantially conical shape, which may be removably attached to the front end portion of the shaft 11. Such a front end portion may have a threaded aperture 20 and the tip member 12 may have an end portion 21 threadably engageable with the aperture 20, as perhaps best shown in FIG. 6. A flight section 13, removably engageable with the shaft section 11, is disposed rearward thereof. The flight section 13 provides aerodynamic stability while the plurality of darts 10 are thrown between remote locations.

Figure 2:
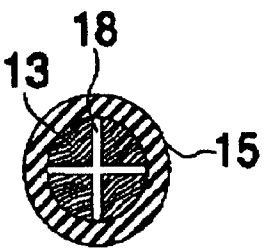
FIG. 2 is an enlarged cross-sectional view of the dart shown in FIG. 1, taken along line 2—2.
Figure 3:
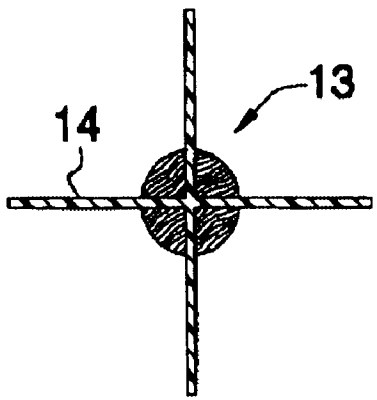
FIG. 3 is an enlarged cross-sectional view of the dart shown in FIG. 1, taken along line 3—3.
Figure 4:
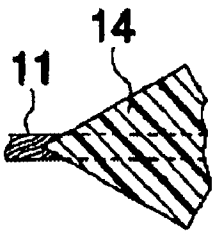
FIG. 4 is an enlarged cross-sectional view of the dart shown in FIG. 1.

The flight section 13 preferably includes a plurality of flight members 14 integral with each other and extending radially and outwardly from the longitudinal axis, as perhaps best shown in FIGS. 2–4. A plurality of slots 18 are provided for receiving the flight members 14 therein. The flight section 13 further includes a front end portion 22 having an outer surface converging distally from a center thereof. Such front end portion has a groove 23 formed therein for receiving the rear end portion 24 of the shaft section 11.

Figure 5:
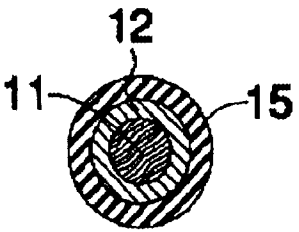
FIG. 5 is an enlarged cross-sectional view of the dart shown in FIG. 1, taken along line 5—5.

As perhaps best shown in FIGS. 1 and 5, a plurality of rubber covers 15 may be connected to the shaft 11 and flight sections 13 respectively for providing a surface, which a user may grip while handling the plurality of darts 10. Now referring to FIG. 7, the present invention further includes at least one target pad 16 including indicia thereon for identifying various point values. Such target pads 16 may be selectively positioned at a remote distance from the plurality of darts 10, as desired by a player.

Figure 6:
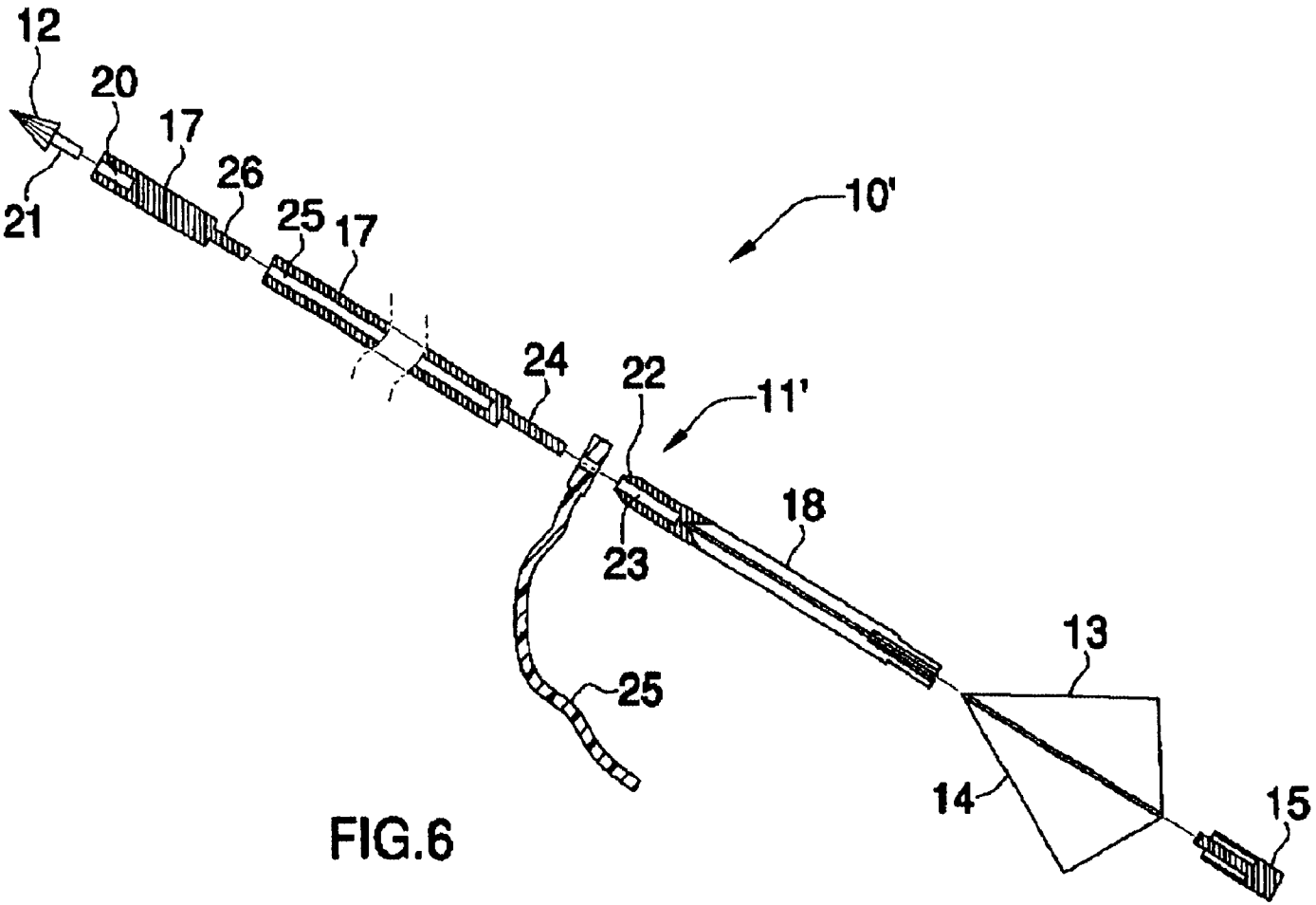
FIG. 6 is an exploded view showing an alternate embodiment of present invention shown in FIG. 1.
Figure 7:
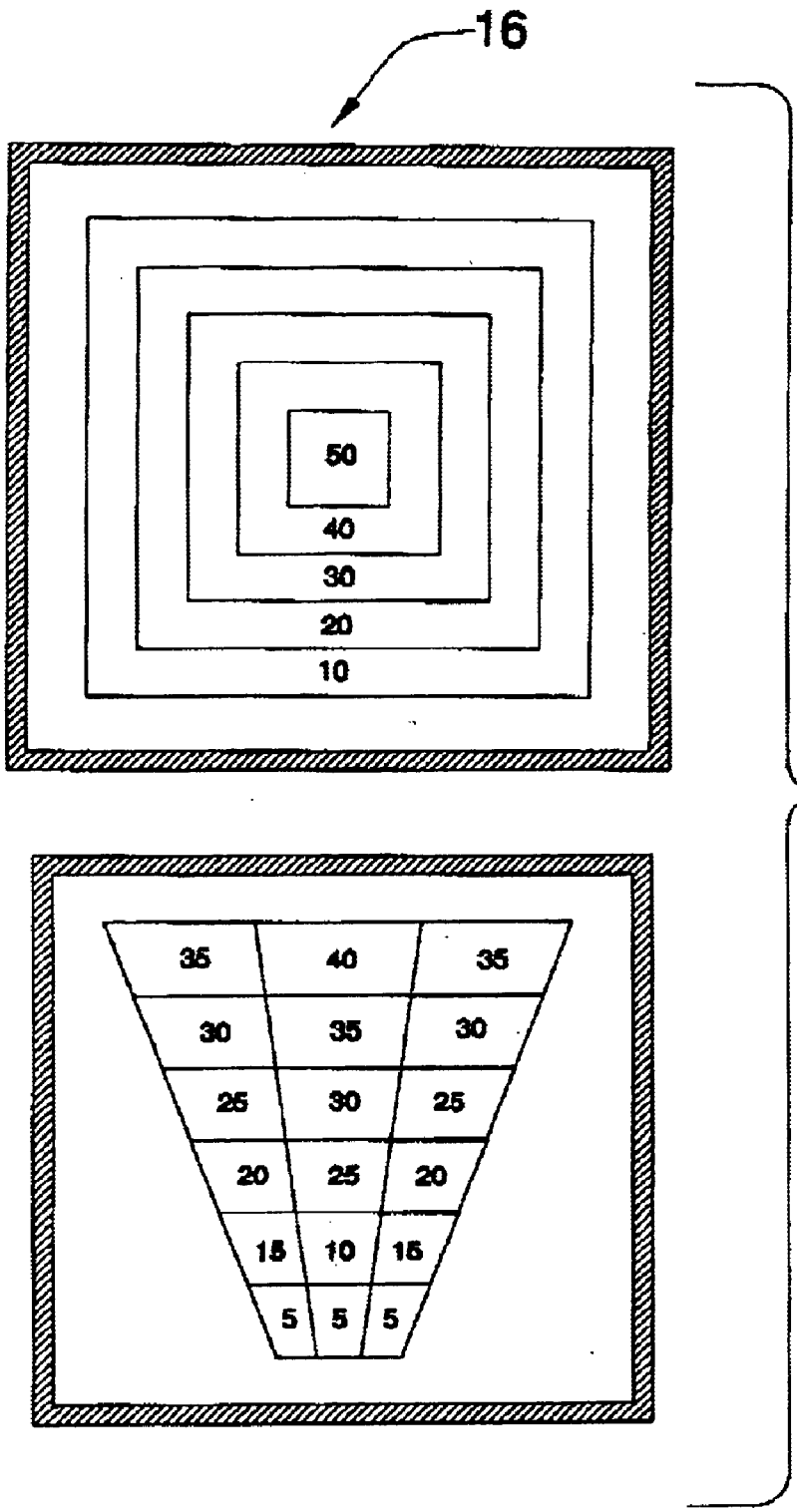
FIG. 7 is a top plane view of the targets.

Referring back to FIG. 6, each dart 10 advantageously includes a flexible cord 25 attachable to the shaft section 11 and for defining a loop for receiving a portion of a hand of a user so that same can throw the dart 10 a further distance. FIG. 6 also illustrates an alternate embodiment 11' of the shaft section that include a plurality of elongated shaft portions 17 removably attachable to each other so that a length of the shaft section 11' can be selectively adjusted, as desired by a user. Such a plurality of shaft portions 17 include a plurality of flange portions 26 and have a plurality of notches 25 for receiving same so that the shaft section 11' can be maintained at a substantially stable position during operating conditions.

Rules of Play

Teams of 1–4 players

Up to 3 teams per side (ie:—Team A, B, C)

Each player has 4 Skydarts each

Each player in turn throws 3 skydarts at target leaving 1 skydart to be thrown (Bonus throw known as the killer skydart).

After each team member from each team (ie:—Home/away sides) has thrown then each team player in turn can then throw the killer skydart at target Any game having to be abandoned due to weather will be played at a later date with consent from both team captains Any skydart not sticking in ground can still score points if tip of skydart is in score zone All players must be able to recognize their own skydart Two referees will be appointed on day of play or official referees will control games played ie:

1 referee to stand at throwing area 1 referee to stand at target area.

Object of Game

1st team to score 500 pts

Target area to be square shape in 6 score sections

Score sections to be reduced in size from outer to centre 5 pts, 10 pts, 15 pts, 20 pts, 50 pts, 100 pts A game can be won outright by any player hitting the centre target with killer skydart only The outright win rule can only be cancelled by another player also hitting the centre of the target with killer skydart only in the same game in progress Any skydart landing on line will receive highest score not lower The target area will be visable by way of a pole with thin strip of ribbon attached to show direction and strength of wind Only when each team player has thrown will anyone be allowed in the target scoring zone Players can only enter scoring zone accompanied by referee Referee can give signals by way of hand to all players to inform how near or far their skydart has landed to the target All players must throw from behind the throwing line Any player throwing from in front of line will forfeit that that throw. (referee to note which skydart was forfeited after landing, and before next throw takes place)

Teams can use players from another team to make up numbers (ie: if 4 players are in team A and 3 in team B then team B can use one team member from team A).

Game Play

Skydart is thrown with the aid of a piece of cord (ie:—string)

The length of cord is twice as long as the longest skydart to be thrown

The cord has a small knot at one end only

By holding the knotted end directly below the flight of the skydart loop the cord over the know and pull the cord with the other hand while still holding the knotted end in place Wrap the loose end of cord around hand until you can hold the skydart with one hand keeping the cord tight over the knot Bring arm right back over shoulder and throw Throwing can be done either from a standing still position or a run up to the line and throw Skydarts are interchangeable to suit the individual Flight sections can vary in shape and length Centre shafts can vary in length Weighted tips can vary in weight and length (each player/team can have their own design, weight and color).

Dart professionals and game lovers alike will find the present invention 10 provides endless hours of fun and excitement. The game can be enjoyed solitarily or with a group and is also transportable allowing the users to travel with it. Enjoying the game 10 on the road, users will enjoy the versatility of the invention allowing use both indoors and out.

While the invention has been described with respect to a certain specific embodiment, it will be appreciated that many modifications and changes may be made by those skilled in the art without departing from the spirit of the invention. It is intended, therefore, by the appended claims to coverall such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A dart game comprising:

a plurality of darts including a shaft section having a centrally disposed longitudinal axis and a substantially smooth outer surface equally spaced therefrom, said shaft section further having front and rear end portions, a tip member having a substantially conical shape and being removably attachable to said front end portion of said shaft, a flight section removably engageable with said shaft section and being disposed rearward thereof, said flight section providing aerodynamic stability while said plurality of darts are being transported between remote locations, said flight section including a plurality of flight members integral with each other and extending radially outwardly from said longitudinal axis, a plurality of rubber covers connected to said shaft and flight sections respectively and for providing a surface which a user may grip while handling said plurality of darts; and a target pad being selectively positionable at a remote distance from said plurality of darts, said target pad including indicia thereon for identifying various point values.

2. The dart game of claim 1, wherein said shaft section comprises:

a plurality of elongated shaft portions removably attachable to each other so that a length of said shaft section can be selectively adjusted as desired by a user.

3. The dart game of claim 2, wherein said plurality of shaft portions comprise:

a plurality of flange portions and have a plurality of notches for receiving same so that said shaft section can be maintained at a substantially stable position during operating conditions.

4. The dart game of claim 1, wherein said flight section further comprises:

a stop member removably engageable therewith and being disposed rearward of said plurality of flight members for preventing same from disengaging from said plurality of slots.

5. The dart game of claim 1, further comprising:

a flexible cord attachable to said shaft section and defining a loop for receiving a portion of a hand of a user so that same can throw said plurality of darts further.

6. The dart game of claim 1, wherein said front end portion of said shaft has a threaded aperture, said tip member having an end portion threadably engageable with said aperture.

7. The dart game of claim 1, wherein said flight section further comprises:

a front end portion having an outer surface converging distally from a center thereof, said rear end portion of said shaft section having a tongue formed thereat for receiving said converging front end portion of said flight section.

8. A dart game comprising:

a plurality of darts including a shaft section having a centrally disposed longitudinal axis and a substantially smooth outer surface equally spaced therefrom, said shaft section further having front and rear end portions, a tip member having a substantially conical shape and being removably attachable to said front end portion of said shaft, a flight section removably engageable with said shaft section and being disposed rearward thereof, said flight section providing aerodynamic stability while said plurality of darts are being transported between remote locations, said flight section including a plurality of flight members integral with each other and extending radially outwardly from said longitudinal axis, said flight section having a plurality of slots for receiving said plurality of flight members therein, said flight section further including a stop member removably engageable therewith and being disposed rearward of said plurality of flight members for preventing same from disengaging from said plurality of slots, a plurality of rubber covers connected to said shaft and flight sections respectively and for providing a surface which a user may grip while handling said plurality of darts; and a target pad being selectively positionable at a remote distance from said plurality of darts, said target pad including indicia thereon for identifying various point values.

9. The dart game of claim 8, wherein said shaft section comprises:

a plurality of elongated shaft portions removably attachable to each other so that a length of said shaft section can be selectively adjusted as desired by a user.

10. The dart game of claim 9, wherein said plurality of shaft portions comprise:

a plurality of flange portions and have a plurality of notches for receiving same so that said shaft section can be maintained at a substantially stable position during operating conditions.

11. The dart game of claim 8, further comprising:

a flexible cord attachable to said shaft section and defining a loop for receiving a portion of a hand of a user so that same can throw said plurality of darts further.

12. The dart game of claim 8, wherein said front end portion of said shaft comprises:

a threaded aperture and said tip member has an end portion threadably engageable with said aperture.

13. The dart game of claim 8, wherein said flight section further comprises:

a front end portion having an outer surface converging distally from a center thereof, said rear end portion of said shaft section having a tongue formed thereat for receiving said converging front end portion of said flight section.

14. A dart game comprising:

a plurality of darts including a plastic shaft section having a centrally disposed longitudinal axis and a substantially smooth outer surface equally spaced therefrom, said shaft section further having front and rear end portions, a fiberglass tip member having a substantially conical shape and being removably attachable to said front end portion of said shaft, an aluminum flight section removably engageable with said shaft section and being disposed rearward thereof, said flight section providing aerodynamic stability while said plurality of darts are being transported between remote locations, said flight section including a plurality of flight members integral with each other and extending radially outwardly from said longitudinal axis, said flight section having a plurality of slots for receiving said plurality of flight members therein, said flight section further including a stop member removably engageable therewith and being disposed rearward of said plurality of flight members for preventing same from disengaging from said plurality of slots, a plurality of rubber covers connected to said shaft and flight sections respectively and for providing a surface which a user may grip while handling said plurality of darts; and a target pad being selectively positionable at a remote distance from said plurality of darts, said target pad including indicia thereon for identifying various point values.

15. The dart game of claim 14, wherein said shaft section comprises:

a plurality of elongated shaft portions removably attachable to each other so that a length of said shaft section can be selectively adjusted as desired by a user.

16. The dart game of claim 15, wherein said plurality of shaft portions comprise:

a plurality of flange portions and have a plurality of notches for receiving same so that said shaft section can be maintained at a substantially stable position during operating conditions.

17. The dart game of claim 14, further comprising:

a flexible cord attachable to said shaft section and defining a loop for receiving a portion of a hand of a user so that same can throw said plurality of darts further.

18. The dart game of claim 14, wherein said front end portion of said shaft has a threaded aperture, said tip member having an end portion threadably engageable with said aperture.

19. The dart game of claim 14, wherein said flight section further comprises:

a front end portion having an outer surface converging distally from a center thereof, said rear end portion of said shaft section having a tongue formed thereat for receiving said converging front end portion of said flight section.

* * * * *